US008084404B2

(12) United States Patent
Tobias et al.

(10) Patent No.: US 8,084,404 B2
(45) Date of Patent: Dec. 27, 2011

(54) CRANKCASE LUBRICATING OIL COMPOSITION FOR PROTECTION OF SILVER BEARINGS IN LOCOMOTIVE DIESEL ENGINES

(75) Inventors: Melanie F. Tobias, Pleasant Hill, CA (US); Kenneth D. Nelson, Napa, CA (US); Elaine S. Yamaguchi, El Cerrito, CA (US); Vernon R. Small, Hercules, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 533 days.

(21) Appl. No.: 11/186,118

(22) Filed: Jul. 20, 2005

(65) Prior Publication Data

US 2007/0021312 A1 Jan. 25, 2007

(51) Int. Cl.

| | |
|---|---|
| ***C10M 137/10*** | (2006.01) |
| ***C10M 159/22*** | (2006.01) |
| ***C10M 171/00*** | (2006.01) |

(52) U.S. Cl. ..... 508/436; 508/574; 508/577

(58) Field of Classification Search ..... 508/436, 508/574, 577

See application file for complete search history.

(56) References Cited

U.S. PATENT DOCUMENTS

| | | | | |
|---|---|---|---|---|
| 2,959,546 | A | 11/1960 | Versteeg | |
| 2,961,405 | A | 11/1960 | Cunningham et al. | |
| 3,267,033 | A | 8/1966 | Allen | |
| 3,649,373 | A | 3/1972 | Dahms | |
| 3,775,321 | A | 11/1973 | Tumquest et al. | |
| 3,933,662 | A * | 1/1976 | Lowe | 508/398 |
| 4,169,799 | A | 10/1979 | Sung et al. | |
| 4,244,827 | A | 1/1981 | Michaelis et al. | |
| 4,278,553 | A | 7/1981 | Sung et al. | |
| 4,285,823 | A | 8/1981 | Sung et al. | |
| 4,431,552 | A | 2/1984 | Salentine | |
| 4,575,431 | A | 3/1986 | Salentine | |
| 4,717,490 | A | 1/1988 | Salentine | |
| 4,734,211 | A | 3/1988 | Kennedy | |
| 4,764,296 | A | 8/1988 | Kennedy | |
| 4,820,431 | A | 4/1989 | Kennedy | |
| 5,244,591 | A | 9/1993 | Middleton | |
| 5,246,605 | A | 9/1993 | Vartanian | |
| 5,302,304 | A | 4/1994 | Valcho | |
| 5,320,766 | A * | 6/1994 | Habeeb et al. | 508/436 |
| 5,370,805 | A * | 12/1994 | Smrcka et al. | 508/542 |
| 5,397,486 | A * | 3/1995 | Small | 508/223 |
| 6,294,506 | B1 * | 9/2001 | Friesen et al. | 508/287 |
| 6,451,745 | B1 * | 9/2002 | Ward | 508/192 |
| 2004/0259743 | A1 | 12/2004 | Butke | |
| 2005/0026791 | A1 | 2/2005 | Esche | |
| 2006/0276352 | A1 * | 12/2006 | Vinci | 508/272 |

FOREIGN PATENT DOCUMENTS

| | | |
|---|---|---|
| CA | 1094053 | 1/1981 |
| EP | 0 460 317 B1 | 3/2000 |
| GB | 1 415 964 | 12/1975 |
| WO | WO 00/11122 | 3/2000 |

* cited by examiner

*Primary Examiner* — Glenn Caldarola
*Assistant Examiner* — Vishal Vasisth

(57) ABSTRACT

The present invention is directed to a crankcase lubricating oil composition for protection of silver bearings in locomotive diesel engines comprising (A) a major amount of an oil of lubricating viscosity, and (B) a silver wear protection additive composition, and (C) one or more detergents. The silver wear protection additive composition of the present invention comprises a mixture of (i) a hydrocarbylamine salt of a di-alkyl di-thiophosphoric acid and (ii) a hydrocarbylamine salt of an alkyl acid phosphate.

24 Claims, No Drawings

CRANKCASE LUBRICATING OIL COMPOSITION FOR PROTECTION OF SILVER BEARINGS IN LOCOMOTIVE DIESEL ENGINES

FIELD OF THE INVENTION

The present invention is directed to a crankcase lubricating oil composition for protection of silver bearings in locomotive diesel engines comprising (A) a major amount of an oil of lubricating viscosity, (B) a silver wear protection additive composition, and (C) one or more detergents. The silver wear protection additive composition of the present invention comprises a mixture of (i) a hydrocarbylamine salt of a di-alkyl di-thiophosphoric acid and (ii) a hydrocarbylamine salt of an alkyl acid phosphate.

BACKGROUND OF THE INVENTION

Lubricating oils for heavy duty diesel engines require crankcase lubricating oils which stabilize against oxidation and which limit the formation of engine deposits. In addition, these crankcase lubricating oils must also have a high alkalinity reserve to neutralize acids formed during fuel combustion.

Many heavy duty locomotive and marine diesel engines in use in the United States and other countries pose an additional lubrication problem. Typically, the older heavy duty diesel engines have silver-surfaced engine parts, such as silver or silver-plated bearings. The silver-plated bearings provide improved fatigue strength and load carrying capacity, along with superior lubricity and corrosion resistance over the older needle bearings. Unfortunately, these silver-plated bearings are incompatible with many conventional additives in lubricating oils for heavy duty diesel engines. Furthermore, silver or silver-plated bearings pose a special problem since many of the bearing protective additives, such as zinc di-alkyl dithiophosphates, which are effective to protect bearings surfaced with other materials, for example, brass, copper, lead, bronze and aluminum, are corrosive to silver or silver-plated bearings.

In the past, silver protection was largely provided by the use of lubricating oils containing chlorinated paraffins, long chain fatty acids and sulfur-containing compounds. However, chlorinated compounds are perceived as having environmental problems and high sulfur-containing compounds have other undesirable effects. Therefore, there is a great need for lubricating oils which do not have the drawbacks discussed above, but provide silver protection. A number of patents have disclosed lubricating oil compositions for silver protection, but none have provided the enhanced protection observed with the lubricating oil composition of the present invention.

Great Britain Patent No. 1,415 964 discloses a composition of additives conferring anti-wear properties to the lubricant with which it is incorporated, without making that lubricant corrosive to silver. The composition contains (A) a triester of phosphorothionic acid, and (B) a triester of ortho-phosphoric acid, or (C) a mixture of hydrocarbyl phosphates of organic bases.

Canadian Patent No. 810120 discloses a lubricating oil composition comprising the reaction product obtained by the neutralization with an alkaline earth metal oxide or hydroxide of a sulfurized alkyl phenate in admixture with a Mannich base reacted with carbon dioxide. The patent suggests that the lubricating oil of the invention is likely to protect silver bearings in railway diesel engines.

U.S. Pat. No. 2,959,546 discloses the use of formaldehyde and/or any compound which will readily decompose to give free formaldehyde to effectively inhibit silver corrosion caused by sulfurized and phosphor-sulfurized additives without interfering with the oxidation inhibiting or other desirable properties of these sulfur-containing additives.

U.S. Pat. No. 3,267,033 discloses a novel composition of matter comprising from about 1 to 3 parts by weight of an oil-soluble fatty acid having at least 12 aliphatic carbon atoms in the fatty radical and from about 1 to 3 parts by weight of a tertiary-aliphatic primary amine salt of a partially esterified phosphoric acid in which the ester radical has from 1 to about 30 aliphatic carbon atoms. The composition imparts desirable frictional characteristics to lubricants.

U.S. Pat. No. 3,649,373 discloses a silver passivating composition consisting of a carrier inert to silver and a thiocarbamic compound.

U.S. Pat. No. 3,775,321 discloses lubricating oil compositions comprising alkali and alkaline earth metal phenates, chlorinated hydrocarbonaceous components, sulfur-containing compounds, naphthyl amines and diamine components which exhibit improved resistance to wear in both silver and bronze engine components.

U.S. Pat. No. 4,169,799 discloses a lubricating oil composition containing a combination of components consisting of an overbased alkaline earth metal containing alkylphenolate and a chlorinated sulfurized alkylphenol.

U.S. Pat. No. 4,244,827 discloses mixtures of di- or tri-thiophosphoric acids di-esters produced from 1,2-diols or 1-mercapto-2-hydroxy compounds by reaction with $P_2S_5$ as excellent stabilizing agents for lubricants.

U.S. Pat. No. 4,278,553 discloses a railway diesel lubricating oil containing a silver corrosion inhibitor comprising a benzotriazole compound present in concentrations from about 0.5 to 2.0 weight percent.

U.S. Pat. No. 4,285,823 discloses a silver corrosion inhibitor for railway diesel engine lubricating oils comprising an N-alkylaminomethyl-5-amino-1H-tetrazole.

U.S. Pat. No. 4,575,431 discloses a lubricating oil additive comprising a mixture of phosphates, said phosphates being essentially free of mono-thiophosphates and comprising (a) di-hydrocarbyl hydrogen di-thiophosphates; and (b) a sulfur-free mixture of hydrocarbyl di-hydrogen phosphates, said composition being at least 50% neutralized by a hydrocarbyl amine having 10 to 30 carbons in said hydrocarbyl group.

U.S. Pat. No. 4,717,490 discloses a lubricating oil containing (1) an alkali metal borate; (2) an oil-soluble sulfur compound; (3) a di-alkyl hydrogen phosphate; and (4) a mixture of neutralized phosphates said phosphates being essentially free of mono-thiophosphates which interact synergistically to provide a lubricant with superior load carrying properties.

U.S. Pat. No. 4,764,296 discloses a lubricating oil composition for railway diesel engines which comprises a lubricating oil base, an ashless dispersant, a mixture of an overbased alkaline earth metal alkylphenolate and alkyl sulfonate compounds and a polyhydroxy compound of up to 60 carbon atoms or a mixture of a polyhydroxy compound of up to 60 carbon atoms and a chlorinated hydrocarbon.

U.S. Pat. No. 4,820,431 discloses a lubricating oil for protection against silver wear in railway diesel engines which is formulated with no chlorinated hydrocarbons or with reduced levels thereof. The composition comprises a silver protective compound selected from the group consisting of (1) $C_8$ to $C_{22}$ fatty acid esters of $C_1$ to $C_{12}$ polyhydroxy alcohols or mixtures of such esters and (2) a mixture comprising the polyhydroxy compound of (1) above, and a chlorinated paraffin.

U.S. Pat. No. 5,244,591 discloses essentially chlorine-free lubricating compositions having a TBN of 10-30 designed for use in internal combustion engines having silver bearing parts which provide protection for said bearings via incorporation therein of certain unsaturated aliphatic carboxylic acids.

U.S. Pat. No. 5,302,304 discloses a method of protecting silver parts and inhibiting copper corrosion in an internal combustion engine and a silver-wear and copper-wear protection additive in a lubricating composition comprising a major proportion of an oil of lubricating viscosity and a minor amount of a silver-wear and copper-corrosion protection additive comprising the reaction product of an amine, formic acid and a $C_5$ to $C_{60}$ carboxylic acid.

U.S. patent application Ser. No. 10/463,932 (Publication No. US 2004/0259743 A1) discloses a lubricating oil composition containing: (1) an anti-wear package comprising: (a) a hydrocarbyl phosphate and amine salt thereof; and (b) an alkylene coupled adduct of a hydrocarbyl substituted dithiophosphoric acid and an α,β-unsaturated carbonyl containing compound; (2) an anti-oxidant package comprising: (a) a hydrocarbyldiphenylamine; and (b) a sterically hindered phenol; (3) a metal deactivator; and (4) an oil of lubricating viscosity. The invention further relates to the process to make the lubricating oil composition and its use in industrial fluids, especially hydraulic fluids.

U.S. patent application Ser. No. 10/630,026 (Publication No. US 2005/0026791 A1) provides an oil-soluble lubricant additive package comprising at least one hydrocarbylamine salt of a di-alkyl mono-thiophosphate. The object of the invention therein is to provide an additive package which can be used to formulate a low sulfur, low ash and low phosphorus content oil for use in gasoline or diesel engines.

SUMMARY OF THE INVENTION

The present invention is directed to a crankcase lubricating oil composition for protection of silver bearings in locomotive diesel engines comprising (A) a major amount of an oil of lubricating viscosity, (B) a silver wear protection additive composition and (C) one or more detergents. The silver wear protection additive composition of the present invention comprises a mixture of (i) a hydrocarbylamine salt of a di-alkyl di-thiophosphoric acid and (ii) a hydrocarbylamine salt of an alkyl acid phosphate.

Specifically, the present invention is directed to a crankcase lubricating oil composition for locomotive diesel engines comprising:

(A) a major amount of an oil of lubricating viscosity;

(B) a silver wear protection additive composition comprising a mixture of (i) a hydrocarbylamine salt of a di-alkyl di-thiophosphoric acid and (ii) a hydrocarbylamine salt of an alkyl acid phosphate; and (C) one or more detergents.

In the silver wear protection additive composition of the above lubricating oil composition, preferably the ratio of the mixture of (i) the hydrocarbylamine salt of the di-alkyl di-thiophosphoric acid and (ii) the hydrocarbylamine salt of the alkyl acid phosphate in (B) to the one or more detergents in (C) is in the range of about 0.01:10 weight percent to about 5:10 weight percent based on the total weight of the lubricating oil composition. Preferably the ratio of (B) to (C) is in the range of about 0.05:10 weight percent to about 3:10 weight percent based on the total weight of the lubricating oil composition. More preferably the ratio of the mixture of (B) to (C) is in the range of about 0.1:10 weight percent to about 1:10 weight percent based on the total weight of the lubricating oil composition.

In the silver wear protection additive composition of the above lubricating oil composition the ratio of (i) to (ii) in (B) is in the range of about 80:20 mole percent to about 20:80 mole percent based on the total moles of (i) and (ii). More preferably the ratio of (i) to (ii) in (B) is in the range of about 60:40 mole percent to about 40:60 mole percent based on the total moles of (i) and (ii). Most preferably the ratio of (i) to (ii) in (B) is about 50:50 mole percent based on the total moles of (i) and (ii).

In the silver wear protection additive composition of the above lubricating oil composition the di-alkyl di-thiophosphoric acid employed to prepare the hydrocarbylamine salt is essentially free of mono-thiophosphates.

The alkyl groups on the di-alkyl di-thiophosphoric acid and the alkyl acid phosphate in silver wear protection additive composition of the above lubricating oil composition independently are linear chain or branched chain alkyl groups. Preferably alkyl groups on the di-alkyl di-thiophosphoric acid and the alkyl acid phosphate are linear chain alkyl groups.

The alkyl groups on the di-alkyl di-thiophosphoric acid and the alkyl acid phosphate in the silver wear protection additive composition of the above lubricating oil composition preferably independently have from about 3 carbon atoms to about 40 carbon atoms. More preferably the alkyl groups on the di-alkyl di-thiophosphoric acid and the alkyl acid phosphate independently have from about 3 carbon atoms to about 20 carbon atoms. Most preferably the alkyl groups on the di-alkyl di-thiophosphoric acid and the alkyl acid phosphate independently have from about 4 carbon atoms to about 10 carbon atoms.

Preferably the hydrocarbyl group on the hydrocarbylamine employed to make the hydrocarbylamine salts employed in the silver wear protection additive composition of the above lubricating oil composition has from about 8 carbon atoms to about 40 carbon atoms. More preferably the hydrocarbyl group on the hydrocarbylamine has from about 12 carbon atoms to about 20 carbon atoms. Preferably the hydrocarbyl group is an aliphatic group. More preferably the aliphatic group is an alkyl group or an alkenyl group. Most preferably the hydrocarbyl group is an alkenyl group.

The hydrocarbylamine salt of the di-alkyl di-thiophosphoric acid and the hydrocarbylamine salt of the alkyl acid phosphate employed in the silver wear protection additive composition of the above lubricating oil composition are mono-hydrocarbylamine salts, di-hydrocarbylamine salts or tri-hydrocarbylamine salts, or mixtures thereof. Preferably the hydrocarbylamine salt of the di-alkyl di-thiophosphoric acid and the hydrocarbylamine salt of the alkyl acid phosphate are mono-hydrocarbylamine salts.

Most preferably the alkyl group on the di-alkyl di-thiophosphoric acid is n-hexyl, and on the alkyl acid phosphate is n-butyl, and the hydrocarbyl group on the hydrocarbylamine is oleyl in the silver wear protection additive composition of above lubricating oil composition.

The one or more detergents in (C) employed in the above lubricating oil composition may be one or a mixture of neutral, low, medium or high overbased metal detergents, which may include sulfurized metal detergents. The high overbased sulfurized metal detergents may be high overbased sulfurized, carbonated metal detergents. Preferably the metal is an alkali metal or an alkaline earth metal. More preferably the metal is an alkaline earth metal, such as calcium or magnesium. Most preferably the alkaline earth metal is calcium.

The lubricating oil composition of the present invention has a Total Base Number in the range of from about 5 to about 30. Preferably the Total Base Number of the lubricating oil composition is in the range of from about 15 to about 25. This is a measure of the alkalinity or neutralizing capacity and is provided by the addition of the metal salts of the detergents employed in the silver wear protection additive composition of the above lubricating oil composition. The function of the metal salt is to neutralize the acid oxidation products, such as sulfuric acid found as combustion by-products in diesel engines that contaminate diesel lubricating oils. Various types of detergents can be used, for example, overbased sulfurized and/or carbonated alkyl phenates, overbased alkyl salicylates and overbased alkyl or alkaryl sulfonates. Mixtures of different detergents may be used in the lubricating oil composition of the present invention. These detergents are readily available commercially.

The lubricating oil composition of the present invention passes the EMD 2-567C "2-Holer" Engine Test.

The above lubricating oil composition may further comprise one or more lubricating oil additives selected from dispersants, anti-oxidants, viscosity index improvers and corrosion inhibitors. Preferably the above lubricating oil composition further comprises one or more dispersants. More preferably the dispersants are ashless dispersants. Most preferably the ashless dispersants are derivatives of succinic anhydride.

A further embodiment of the present invention is directed to a lubricating oil concentrate comprising:

(A) from about 90 weight percent to about 10 weight percent of an oil of lubricating viscosity; and (B) from about 10 weight percent to about 90 weight percent of (a) a silver wear protection additive composition comprising a mixture of (i) a hydrocarbylamine salt of a di-alkyl di-thiophosphoric acid and (ii) a hydrocarbylamine salt of an alkyl acid phosphate, and (b) one or more detergents.

In the silver wear protection additive composition of the above lubricating oil concentrate, preferably in (B) the ratio of the mixture of the (i) hydrocarbylamine salt of the di-alkyl di-thiophosphoric acid and (ii) the hydrocarbylamine salt of the alkyl acid phosphate in (a) to the one or more detergents in (b) is in the range of about 0.01:10 weight percent to about 5:10 weight percent based on the total weight of the lubricating oil concentrate. Preferably the ratio of (a) to (b) is in the range of about 0.05:10 weight percent to about 3:10 weight percent based on the total weight of the lubricating oil concentrate. More preferably the ratio of (a) to (b) is in the range of about 0.1:10 weight percent to about 1:10 weight percent based on the total weight of the lubricating oil concentrate.

In the silver wear protection additive composition of the above lubricating oil concentrate, the ratio of (i) to (ii) in (a) is in the range of about 80:20 mole percent to about 20:80 mole percent based on the total moles of (i) and (ii). More preferably the ratio of (i) to (ii) in (a) is in the range of about 60:40 mole percent to about 40:60 mole percent based on the total moles of (i) and (ii). Most preferably the ratio of (i) to (ii) in (a) is about 50:50 mole percent based on the total moles of (i) and (ii).

In the silver wear protection additive composition of the above lubricating oil concentrate, the di-alkyl di-thiophosphoric acid employed to prepare the hydrocarbylamine salt is essentially free of mono-thiophosphates.

The alkyl groups on the di-alkyl di-thiophosphoric acid and the alkyl acid phosphate in silver wear protection additive composition of the above lubricating oil concentrate independently are linear chain or branched chain alkyl groups. Preferably alkyl groups on the di-alkyl di-thiophosphoric acid and the alkyl acid phosphate are linear chain alkyl groups.

The alkyl groups on the di-alkyl di-thiophosphoric acid and the alkyl acid phosphate in the silver wear protection additive composition of the above lubricating oil concentrate preferably independently have from about 3 carbon atoms to about 40 carbon atoms. More preferably the alkyl groups on the di-alkyl di-thiophosphoric acid and the alkyl acid phosphate independently have from about 3 carbon atoms to about 20 carbon atoms. Most preferably the alkyl groups on the di-alkyl di-thiophosphoric acid and the alkyl acid phosphate independently have from about 4 carbon atoms to about 10 carbon atoms.

Preferably the hydrocarbyl group on the hydrocarbylamine employed to make the hydrocarbylamine salts in the silver wear protection additive composition of the above lubricating oil concentrate has from about 8 carbon atoms to about 40 carbon atoms. More preferably the hydrocarbyl group on the hydrocarbylamine has from about 12 carbon atoms to about 20 carbon atoms. Preferably the hydrocarbyl group is an aliphatic group. More preferably the aliphatic group is an alkyl group or an alkenyl group. Most preferably the hydrocarbyl group is an alkenyl group.

The hydrocarbylamine salt of the di-alkyl di-thiophosphoric acid and the hydrocarbylamine salt of the alkyl acid phosphate employed in the silver wear protection additive composition of the above lubricating oil concentrate are mono-hydrocarbylamine salts, di-hydrocarbylamine salts or tri-hydrocarbylamine salts, or mixtures thereof. Preferably the hydrocarbylamine salt of the di-alkyl di-thiophosphoric acid and the hydrocarbylamine salt of the alkyl acid phosphate are mono-hydrocarbylamine salts.

Most preferably the alkyl group on the di-alkyl di-thiophosphoric acid is n-hexyl, the alkyl acid phosphate is n-butyl, and the hydrocarbyl group on the hydrocarbylamine is oleyl as employed in the silver wear protection additive composition of the above lubricating oil concentrate.

The one or more detergents in (b) employed in the silver wear protection additive composition of the above lubricating oil concentrate may be a mixture of low, medium or high overbased metal detergents, which may be sulfurized and/or carbonated metal detergents. Preferably the metal is an alkali metal or an alkaline earth metal. More preferably the metal is an alkaline earth metal, such as calcium or magnesium. Most preferably the alkaline earth metal is calcium.

The above lubricating oil composition may further comprise one or more lubricating oil additives selected from dispersants, anti-oxidants, viscosity index improvers and corrosion inhibitors. Preferably the above lubricating oil composition further comprises one or more dispersants. More preferably the dispersants are ashless dispersants. Most preferably the ashless dispersants are derivatives of succinic anhydride.

Another embodiment of the present invention is directed to a method for protecting silver bearings in a locomotive diesel engine crankcase comprising contacting the silver bearings with the lubricating oil composition comprising:

(A) a major amount of an oil of lubricating viscosity;

(B) a silver wear protection additive composition comprising a mixture of (i) a hydrocarbylamine salt of a di-alkyl di-thiophosphoric acid and (ii) a hydrocarbylamine salt of an alkyl acid phosphate; and (C) one or more detergents.

In the silver wear protection additive composition of the above method, preferably the ratio of the mixture of the (i) hydrocarbylamine salt of the di-alkyl di-thiophosphoric acid and (ii) the hydrocarbylamine salt of the alkyl acid phosphate in (B) to the one or more detergents in (C) is in the range of about 0.01:10 mole percent to about 5:10 weight percent based on the total weight of the lubricating oil composition. Preferably the ratio of (B) to (C) is in the range of about 0.05:10 weight percent to about 3:10 weight percent based on the total weight of the lubricating oil composition. More preferably the ratio of (B) to (C) is in the range of about 0.1:10 weight percent to about 1:10 weight percent based on the total weight of the lubricating oil composition.

In the silver wear protection additive composition of the above lubricating method, the ratio of (i) to (ii) in (B) is in the range of about 80:20 mole percent to about 20:80 mole percent based on the total moles of (i) and (ii). More preferably the ratio of (i) to (ii) in (B) is in the range of about 60:40 mole percent to about 40:60 mole percent based on the total moles of (i) and (ii). Most preferably the ratio of (i) to (ii) in (B) is about 50:50 mole percent based on the total moles of (i) and (ii).

In the silver wear protection additive composition of the above method, the di-alkyl di-thiophosphoric acid employed to prepare the hydrocarbylamine salt is essentially free of mono-thiophosphates.

The alkyl groups on the di-alkyl di-thiophosphoric acid and the alkyl acid phosphate in silver wear protection additive composition of the above method independently are linear chain or branched chain alkyl groups. Preferably alkyl groups on the di-alkyl di-thiophosphoric acid and the alkyl acid phosphate are linear chain alkyl groups.

The alkyl groups on the di-alkyl di-thiophosphoric acid and the alkyl acid phosphate in the silver wear protection additive composition of the above method preferably independently have from about 3 carbon atoms to about 40 carbon atoms. More preferably the alkyl groups on the di-alkyl di-thiophosphoric acid and the alkyl acid phosphate independently have from about 3 carbon atoms to about 20 carbon atoms. Most preferably the alkyl groups on the di-alkyl di-thiophosphoric acid and the alkyl acid phosphate independently have from about 4 carbon atoms to about 10 carbon atoms.

Preferably the hydrocarbyl group on the hydrocarbylamine employed to make the hydrocarbylamine salts in the silver wear protection additive composition of the above method has from about 8 carbon atoms to about 40 carbon atoms. More preferably the hydrocarbyl group on the hydrocarbylamine has from about 12 carbon atoms to about 20 carbon atoms. Preferably the hydrocarbyl group is an aliphatic group. More preferably the aliphatic group is an alkyl group or an alkenyl group. Most preferably the hydrocarbyl group is an alkenyl group.

The hydrocarbylamine salt of the di-alkyl di-thiophosphoric acid and the hydrocarbylamine salt of the alkyl acid phosphate employed in the silver wear protection additive composition of the above method are mono-hydrocarbylamine salts, di-hydrocarbylamine salts or tri-hydrocarbylamine salts, or mixtures thereof. Preferably the hydrocarbylamine salt of the di-alkyl di-thiophosphoric acid and the hydrocarbylamine salt of the alkyl acid phosphate are mono-hydrocarbylamine salts.

Most preferably the alkyl group on the di-alkyl di-thiophosphoric acid is n-hexyl, the alkyl acid phosphate is n-butyl, and the hydrocarbyl group on the hydrocarbylamine is oleyl employed in the silver wear protection additive composition of the method.

The one or more detergents in (C) employed in the lubricating oil composition of the above method may be a mixture of neutral, or low, medium or high overbased metal detergents, which may or may not be sulfurized and/or carbonated metal detergents. Preferably the metal is an alkali metal or an alkaline earth metal. More preferably the metal is an alkaline earth metal, such as calcium or magnesium. Most preferably the alkaline earth metal is calcium.

The above lubricating oil composition further comprises one or more lubricating oil additives selected from dispersants, anti-oxidants, viscosity index improvers and corrosion inhibitors. Preferably the above lubricating oil composition further comprises one or more dispersants. More preferably the dispersants are ashless dispersants. Most preferably the ashless dispersants are derivatives of succinic anhydride.

A further embodiment of the present invention is a silver surface protection composition comprising:

a mixture of (i) a hydrocarbylamine salt of a di-alkyl di-thiophosphoric acid and (ii) a hydrocarbylamine salt of an alkyl acid phosphate.

In the above silver surface protection composition the ratio of (i) the hydrocarbylamine salt of the di-alkyl di-thiophosphoric acid to (ii) the hydrocarbylamine salt of the alkyl acid phosphate in the silver protection composition is in the range of about 80:20 mole percent to about 20:80 mole percent based on the total moles of the hydrocarbylamine salts of the di-alkyl di-thiophosphoric acid and the alkyl acid phosphate. Preferably the ratio of (i) the hydrocarbylamine salt of the di-alkyl di-thiophosphoric acid to (ii) the hydrocarbylamine salt of the alkyl acid phosphate is 50:50 mole percent based on the total mole of the hydrocarbylamine salts of the di-alkyl di-thiophosphoric acid and the alkyl acid phosphate.

The alkyl groups on the di-alkyl di-thiophosphoric acid and the alkyl acid phosphate in the silver surface protection composition of the above method preferably independently have from about 3 carbon atoms to about 40 carbon atoms. More preferably the alkyl groups on the di-alkyl di-thiophosphoric acid and the alkyl acid phosphate independently have from about 3 carbon atoms to about 20 carbon atoms. Most preferably the alkyl groups on the di-alkyl di-thiophosphoric acid and the alkyl acid phosphate independently have from about 4 carbon atoms to about 10 carbon atoms.

Preferably the hydrocarbyl group on the hydrocarbylamine employed to make the hydrocarbylamine salts in the silver surface protection composition of the above method has from about 8 carbon atoms to about 40 carbon atoms. More preferably the hydrocarbyl group on the hydrocarbylamine has from about 12 carbon atoms to about 20 carbon atoms. Preferably the hydrocarbyl group is an aliphatic group. More preferably the aliphatic group is an alkyl group or an alkenyl group. Most preferably the hydrocarbyl group is an alkenyl group.

Most preferably the alkyl group on the di-alkyl di-thiophosphoric acid is n-hexyl, the alkyl acid phosphate is n-butyl, and the hydrocarbyl group on the hydrocarbylamine is oleyl employed in the silver surface protection composition of the above lubricating oil concentrate.

The silver surface protection composition of the present invention may further comprise an organic solvent. Preferably the organic solvent is selected from an alkanol, a halogenated hydrocarbon, an ether or a ketone.

DETAILED DESCRIPTION OF THE INVENTION

Definitions

As used herein, the following terms have the following meanings unless expressly stated to the contrary:

The term "alkali metal" as used herein refers to Group I metals of the Periodic Table, such as sodium, potassium and lithium.

The term "alkaline earth metal" as used herein refers to Group II metals of the Periodic Table, such as calcium and magnesium.

The term "detergents" as used herein refers to additives designed to disperse acid-neutralizing compounds in solution in the oil. They are usually alkaline and react with the acids which form during the combustion of the fuel and which would otherwise cause corrosion to the engine parts if left unchecked. Suitable detergents for use in the present invention are, for example, alkali metal or alkaline earth metal salts of alkyl sulfonates, alkyl phenates and Mannich base condensation products. These detergents may be sulfurized and/or carbonated. Numerous detergents are commercially readily available.

The term "dispersants" as used herein refers to additives that keep soot and combustion products in suspension in the body of the oil charge and therefore prevent deposition as sludge or lacquer. Examples of ashless dispersants are succinimides and succinate esters. A large number of dispersants are commercially available.

The term "hydrocarbylamine" as used herein refers to a primary hydrocarbylamine, secondary hydrocarbylamine or tertiary hydrocarbylamine. Hydrocarbyl refers to an organic radical composed of carbon and hydrogen which may be aliphatic, alicyclic, aromatic, or mixtures thereof. Preferably the hydrocarbyl group is an aliphatic group. More preferably the aliphatic group is an alkyl group or an alkenyl group. Most preferably the hydrocarbyl group is an alkenyl group. It is preferred that the hydrocarbylamine salt of the di-alkyl di-thiophosphoric acid and the alkyl acid phosphate is a monoamine salt wherein the aliphatic alkyl group has from about 8 carbon atoms to about 40 carbon atoms. The hydrocarbylamine can be a mixture of amines. Typical aliphatic alkyl amines include pentadecylamine, octadecylamine, cetylamine, and the like. Most preferred is oleylamine.

The term "locomotive diesel engine oil" as used herein refers to an engine oil used in medium speed diesel engines as commonly found in railroad locomotives, marine tugboats, and stationary power applications.

The term "overbased" as used herein refers to alkaline earth metal alkyl phenates, alkyl salicylates and alkyl sulfonates in which the ratio of the number of equivalents of an alkaline earth metal to the number of equivalents of the organic moiety is greater than 1. Low overbased refers to alkaline earth metal alkyl phenates, alkyl salicylates and alkyl sulfonates having a Total Base Number (TBN) greater than 1 and less than 20, medium overbased refers to alkaline earth metal alkyl phenates, alkyl salicylates and alkyl sulfonates having a TBN greater than 20 and less than 200. High overbased refers to alkaline earth metal alkyl phenates, alkyl salicylates and alkyl sulfonates having a TBN greater than 200.

The term "mono-thiophosphates" as used herein refers to compounds having the formula below:

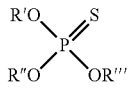

wherein R', R" and R''' are independently hydrogen, or alkyl having from about 3 carbon atoms to about 40 carbon atoms.

The term "silver protection" as used herein refers to the ability of the lubricating oil composition of the present invention to protect silver and silver-plated bearings in a locomotive diesel engine crankcase from the harmful effects of overbased detergents used in such lubricating oil for detergency and deposit control. Without being bound by any theory, it is believed that the alkyl amine or alkenyl amine salt of the di-alkyl dithiophosphoric acid and the alkyl amine or alkenyl amine salt of the alkyl acid phosphate in the lubricating oil composition of the present invention confer wear protection of the silver and silver plated bearings in a locomotive diesel engine crankcase in the presence of overbased detergents.

The term "Total Base Number" or "TBN" as used herein refers to the amount of base equivalent to milligrams of KOH in one gram of sample. Thus, higher TBN numbers reflect more alkaline products, and therefore a greater alkalinity.

Unless otherwise specified, all percentages are in weight percent.

Lubricating Oil Composition

It has been discovered that silver and silver plated bearings in crankcases of locomotive diesel engines can be protected against wear caused by the overbased detergents used in conventional diesel lubricating oils by the addition of a mixture of (i) a hydrocarbylamine salt of a di-alkyl di-thiophosphoric acid and (ii) a hydrocarbylamine salt of an alkyl acid phosphate.

The lubricating oil composition of the present invention comprises (A) a major amount of an oil of lubricating viscosity, (B) a silver wear protection additive composition comprising a mixture of (i) a hydrocarbylamine salt of a di-alkyl di-thiophosphoric acid and (ii) a hydrocarbylamine salt of an alkyl acid phosphate and (C) one or more detergents. Optionally the silver wear protection additive composition may contain one or more dispersants. The lubricating oil composition of the present invention may be prepared by simple blending or mixing of the compounds described in more detail below. These compounds may also be preblended as a concentrate or package with various other additives in appropriate ratios to facilitate blending of a lubricating oil composition containing the desired concentration of additives.

Oil of Lubricating Viscosity

Oil of lubricating viscosity, or base oil as used herein refers to lubricating oils which may be mineral oils or synthetic oils of lubricating viscosity and preferably useful in the crankcase of an internal combustion engine. Crankcase lubricating oils ordinarily have a viscosity of about 1300 centistokes at −17.8° C. to 22.7 centistokes at 98.9° C. The lubricating oils may be derived from synthetic or natural sources. Mineral oil for use as the base oil in this invention includes paraffinic, naphthenic and other oils that are ordinarily used in lubricating oil compositions. Synthetic oils include hydrocarbon synthetic oils and synthetic esters. Useful synthetic hydrocarbon oils include liquid polymers of alpha-olefins having the proper viscosity. Especially useful are the hydrogenated liquid oligomers of $C_6$ to $C_{12}$ alpha-olefins such as 1-decene trimer. Similarly, alkyl benzenes of proper viscosity, such as didodecyl benzene, may be used. Useful synthetic esters include the esters of both mono-carboxylic acids and polycarboxylic acids as well as mono-hydroxy alkanols and polyols. Typical examples are didodecyl adipate, pentaerthritol tetracapoate, di-2-ethylhexyl adipate, di-laurylsebacate and the like. Complex esters prepared from mixtures of mono- and di-carboxylic acid and mono- and di-hydroxy alkanols can also be used. Blends of hydrocarbon oils and synthetic oils may also be used. For example, blends of 10 weight percent to 25 weight percent hydrogenated 1-decene trimer with 75 weight percent to 90 weight percent 683 centistokes at 37.8° C. mineral oil gives an excellent oil base. Fischer- Tropsch derived base oils may also be employed in the lubricating oil composition of the present invention.

The Hydrocarbyl Amine Salt of Di-alkyl di-thiophosphoric Acid and the Hydrocarbyl Amine Salt of Alkyl Acid Phosphate Typically the desired concentration of the hydrocarbylamine salt of the di-alkyl di-thiophosphoric acid and the hydrocarbylamine salt of the alkyl acid phosphate in the lubricating oil composition of the present invention are in the range of from about 0.01 weight percent to about 5.0 weight percent based on the total weight of the lubricating oil composition of the present invention. Preferably the hydrocarbyl amine salt of the di-alkyl di-thiophosphoric acid and the hydrocarbyl amine salt of the alkyl acid phosphate are in the range of from about 0.5 weight percent to about 3.0 weight percent based on the total weight of the lubricating oil composition of the present invention. Most preferably the hydrocarbyl amine salt of the di-alkyl di-thiophosphoric acid and the hydrocarbyl amine salt of the alkyl acid phosphate are in the range of from about 0.1 weight percent to about 1.0 weight percent based on the total weight of the lubricating oil composition of the present invention.

The hydrocarbylamine salts of the di-alkyl di-thiophosphoric acid and the salt of the alkyl acid phosphate for use in the silver wear protection additive composition may be prepared by (1) first making the desired mixture of the di-alkyl di-thiophosphoric acid and the alkyl acid phosphate, and then preparing the hydrocarbylamine salt of the mixture, or (2) by making the hydrocarbylamine salt separately of each of the di-alkyl di-thiophosphoric acid and of the alkyl acid phosphate and then mixing the two salts to obtain the desired ratios of each.

The Hydrocarbyl Amine Salt of Di-alkyl di-thiophosphoric Acid

The hydrocarbylamine salt of the di-alkyl di-thiophosphoric acid is the alkyl amine or alkenyl amine salt of a compound having the formula:

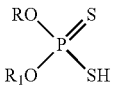

wherein R and $R_1$ are independently linear chain or branched chain alkyl groups having from about 3 carbon atoms to about 40 carbon atoms. Preferably R and $R_1$ are linear chain alkyl groups.

Examples of di-alkyl di-thiophosphoric acid used for making the hydrocarbylamine salt include di-2-ethyl-1-hexyl hydrogen di-thiophosphoric acid, di-hexyl hydrogen di-thiophosphoric acid, di-isooctyl hydrogen di-thiophosphoric acid, di-propyl hydrogen di-thiophosphoric acid, di-butyl hydrogen di-thiophosphoric and di-4-methyl-2-pentyl hydrogen di-thiophosphoric acid. Preferred di-thiophosphoric acids are di-hexyl hydrogen di-thiophosphoric acid, di-butyl hydrogen di-thiophosphoric acid and di-n-hexyl hydrogen di-thiophosphoric acid. Most preferred di-alkyl di-thiophosphoric acid used for making the hydrocarbylamine salt in the present invention is di-n-hexyl hydrogen di-thiophosphoric acid.

The hydrocarbylamine salts of the di-alkyl di-thiophosphoric acids are prepared using primary hydrocarbylamine, secondary hydrocarbylamine or tertiary hydrocarbyl amine, or mixtures thereof. Preferably the hydrocarbyl group is an aliphatic group. More preferably the aliphatic group is an alkyl group or an alkenyl group. Most preferably the hydrocarbyl group is an alkenyl group. It is preferred that the hydrocarbylamine salt of the di-alkyl di-thiophosphoric acid and the alkyl acid phosphate is a mono-amine salt wherein the aliphatic alkyl group has from about 8 carbon atoms to about 40 carbon atoms. The hydrocarbylamine can be a mixture of amines. Typical aliphatic alkyl amines include pentadecylamine, octadecylamine, cetylamine, and the like. Most preferred is oleyl amine.

The procedure for making the di-alkyl di-thiophosphoric acids and their alkyl amine or alkenyl amine salts is well known in the art.

The di-alkyl dithiophosphoric acid used to make the alkyl amine or alkenyl amine salt for use in the lubricating oil composition of the present invention is essentially free of mono-thiophosphate.

The Hydrocarbyl Amine Salt of Alkyl Acid Phosphate

Hydrocarbyl amine salt of acid phosphate as used herein refers to mixtures of di-alkyl mono-hydrogen phosphate and mono-alkyl di-hydrogen phosphates. These compounds have the formulas below:

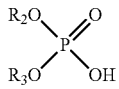

and

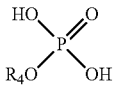

wherein $R_2$, $R_3$ and $R_4$ are independently linear chain or branched chain alkyl having from about 3 carbon atoms to about 40 carbon atoms. Preferably $R_2$, $R_3$ and $R_4$ are linear chain alkyl groups.

Examples of alkyl acid phosphates that may be employed to make the hydrocarbyl amine salt of the present invention are propyl di-hydrogen phosphates, di-propyl hydrogen phosphates, butyl di-hydrogen phosphates, di-butyl hydrogen phosphates, pentyl di-hydrogen phosphates, di-pentyl hydrogen phosphates hexyl di-hydrogen phosphates, di-hexyl hydrogen phosphates, heptyl di-hydrogen phosphates, di-heptyl hydrogen phosphates, octyl di-hydrogen phosphates, di-octyl hydrogen phosphates, decyl di-hydrogen phosphate, di-decyl hydrogen phosphate and the like. Preferred is a mixture of di-butyl hydrogen phosphate and butyl di-hydrogen phosphate. More preferred is butyl di-hydrogen phosphate.

The hydrocarbylamine salts of the alkyl acid phosphates are prepared using primary hydrocarbylamine, secondary hydrocarbylamine or tertiary hydrocarbyl amine, or mixtures thereof. Preferably the hydrocarbyl group is an aliphatic group. More preferably the aliphatic group is an alkyl group or an alkenyl group. Most preferably the hydrocarbyl group is an alkenyl group. It is preferred that the hydrocarbylamine salt of the di-alkyl di-thiophosphoric acid and the alkyl acid phosphate is a mono-amine salt wherein the aliphatic alkyl group has from about 8 carbon atoms to about 40 carbon atoms. The hydrocarbylamine can be a mixture of amines. Typical aliphatic amines include pentadecylamine, octadecylamine, cetylamine, and the like. Most preferred is oleyl amine.

The procedure for making the di-alkyl di-thiophosphoric acids and their alkyl amine or alkenyl amine salts is well known in the art.

Detergents

Detergents are used in lubricating oil to neutralize acid oxidation products, such as sulfuric acid in the case of diesel fuel and to control deposits. Detergents useful in the silver wear protection additive composition of the present invention may be neutral, or low, medium or high overbased detergents, or a mixture thereof. The detergents may be sulfurized and/or carbonated. Typically, the ratio of the low and medium overbased detergents to the high overbased detergents is in the range of about 70:30 weight percent to about 30:70 weight percent based on the total weight of the detergents in the silver wear protection additive composition of the present invention. Preferably the ratio of the low and medium overbased detergents to the high overbased detergents is in the range of about 60:40 weight percent to about 40:60 weight percent based on the total weight of the detergents in the silver wear protection additive composition. More preferably the ratio of the low and medium overbased detergents to the high overbased detergents is about 50:50 weight percent based on the total weight of the detergents in the silver wear protection additive composition.

The ratio of the silver wear protection additive composition to the detergents employed in the lubricating oil composition of the present invention are present in the range of from about 0.01:10 weight percent to about 5:10 weight percent based on the total weight of the lubricating oil composition of the present invention. Preferably the ratio of the silver wear protection additive composition to the detergents in the lubricating oil composition of the present invention are present in the range of from about 0.05:10 weight percent to about 3:10 weight percent based on the total weight of the lubricating oil composition of the present invention. More preferably the ratio of the silver wear protection additive composition to the detergents in the lubricating oil composition of the present invention are present in the range of from about 0.1:10 weight percent to about 1:10 weight percent based on the total weight of the lubricating oil composition of the present invention.

Low and Medium Overbased Metal Detergents

Examples of the low and medium overbased metal detergents are low or medium overbased sulfonic acids, salicylic acids, carboxylic acids, or phenols or Mannich condensation products of phenols, aldehydes and amines. These detergents may or may not be sulfurized. These detergents may be alkali metal detergents or alkaline earth metal detergents. Preferably they are alkaline earth metal detergents and more preferably they are calcium detergents. The TBN of these detergents is greater than 1 and less that 200. More preferably the detergents are medium overbased sulfurized alkyl phenates, wherein the metal is an alkaline earth metal and the alkyl group has from about 6 carbon atoms to about 30 carbon atoms. These detergents are well known in the art and are commercially available.

High Overbased Detergents

Various types of overbased materials may be used, such as sulfurized and/or carbonated phenates, salicylates and sulfonates, which are readily available. The high overbased detergents are salts of alkaline earth metals, preferably calcium. The TBN of these detergents is greater than 200. More preferably the high overbased detergent is an overbased sulfurized, carbonated alkyl phenate, wherein the metal is an alkaline earth metal and the alkyl group has from about 6 carbon atoms to about 30 carbon atoms. These detergents are readily available commercially.

Other Additives

The lubricating oil composition of the present invention may also typically contain, in addition to the alkyl amine or alkenyl amine salt of the di-alkyl di-thiophosphoric acid and the alkyl amine or alkenyl amine salt of the alkyl acid phosphate of the present invention, other additives used to impart desirable properties to the lubricating oil composition of the present invention. Thus, the lubricating oil may contain one or more of additives, such as, dispersants, oxidation inhibitors, corrosion inhibitors and viscosity index improvers to regulate viscosity changes due to temperature.

For best overall results in terms of affording the properties desired in a conventional lubricating oil composition for a locomotive diesel engine crankcase lubricating oil, the lubricating oil contains a compatible combination of additives of each of the above classes of additives in effective amounts as well as the alkyl amine or alkenyl amine salt of the di-alkyl di-thiophosphoric acid and the alkyl amine or alkenyl amine salt of the alkyl acid phosphate of the present invention and a sufficient amount of detergents to provide the desired neutralization capacity.

Dispersants

The lubricating oil composition of the present invention optionally contains ashless dispersants. Typically, the ashless dispersants are nitrogen-containing dispersants formed by reacting alkenyl succinic anhydride with an amine. Examples of such dispersants are alkenyl succinimides and succinamides. These dispersants can be further modified by reaction with, for example, boron or ethylene carbonate. Ester-based ashless dispersants derived from long chain hydrocarbon-substituted carboxylic acids and hydroxy compounds may also be employed. Preferred ashless dispersants are those derived from polyisobutenyl succinic anhydride. These dispersants are commercially available.

Oxidation Inhibitors

Anti-oxidants are used in lubricating oils for inhibition of decomposition processes that occur naturally in lubricating oils as they age or oxidize in the presence of air. These oxidation processes may cause formation of gums, lacquers and sludge resulting in an increase in acidity and viscosity. Examples of useful anti-oxidants are hindered phenols, alkylated and non-alkylated aromatic amines, alkyl or aryl phosphates, esters of thiodicarboxylic acids, salts of carbamic or di-thiophosphoric acids.

Viscosity Index Improvers

Viscosity index improvers are added to lubricating oil to regulate viscosity changes due to the change in temperature. Some commercially available examples of viscosity index improvers are olefin copolymers, polybutene, polymethacrylates, vinylpyrrolidone and methacrylate copolymers.

Corrosion Inhibitors

Corrosion inhibitors are included in lubricating oils to protect vulnerable metal surfaces. Such corrosion inhibitors are generally used in very small amounts in the range of from about 0.02 weight percent to about 1.0 weight percent. The corrosion inhibitor should not be one that is itself corrosive to silver and silver-plated bearings, such as, metal di-thiophosphates. Examples of corrosion inhibitors that may be used are derivatives of 2,5-dimercapto-1,3,5-thiadiazole, including 2,5-di-t-nonyldithio-1,3,5-thiadiazole.

In addition to the materials already described, lubricating oil composition of the present invention may also include other additives, such as pour point depressants and anti-foaming agents. The various additive materials or classes of materials herein described are well known materials and can be readily purchased commercially or prepared by known procedures or obvious modification thereof.

The mixture of a hydrocarbylamine salt of a di-alkyl di-thiophosphoric acid and a hydrocarbylamine salt of an alkyl acid phosphate employed as a silver wear protection additive in the present invention may also be used for protection of silver surfaces. More specifically a further embodiment of the present invention is a silver surface protection composition comprising:

a mixture of (i) a hydrocarbylamine salt of a di-alkyl di-thiophosphoric acid and (ii) a hydrocarbylamine salt of an alkyl acid phosphate.

In the silver surface protection composition the ratio of (i) the hydrocarbylamine salt of the di-alkyl di-thiophosphoric acid to (ii) the hydrocarbylamine salt of the alkyl acid phosphate in the silver surface protection composition is in the range of about 80:20 mole percent to about 20:80 mole percent based on the total moles of the hydrocarbylamine salts of the di-alkyl di-thiophosphoric acid and the alkyl acid phosphate. More preferably the ratio of (i) to (ii) is 50:50 mole percent based on the total moles of (i) and (ii).

The silver surface protection composition of the present invention may further comprise an organic solvent. When employed, preferably the organic solvent is selected from an alkanol, a halogenated hydrocarbon, an alkyl ether or an alkyl ketone. The alkanol may be a mono-alkanol or a di-alkanol. The alkyl ether may be a mono-alkyl ether or a di-alkyl ether. Examples of suitable organic solvents are ethanol, dioxane, 1,1,1-trichloroethane and carbon tetrachloride.

Also contemplated is replacing the organic solvent in the above embodiment with a hydrocarbon, such as petroleum jelly or paraffin oil.

EXAMPLES

Example 1

Silver Wear Evaluation Using a Modified Silver Disk Wear and Friction Test

The Modified Silver Disk Wear and Friction Test, a bench test, was used to determine the anti-wear and frictional characteristics of the lubricating oil composition comprising the silver wear additive composition of the present invention. The test machine is a modification of the Falex 4-Ball machine comprising a 1.27 centimeter diameter ANSI 52100 grade steel ball placed in the assembly with three 0.64 centimeter diameter by 1.59 millimeters thick silver disks of a quality identical to that employed in plating of the silver pin insert bearing or railroad diesel engine manufactured by Electromotive Division (EMD) of General Motors, Inc. These disks are in a fixed triangular position in a reservoir containing the oil sample to be tested for its silver anti-wear and frictional properties. The steel ball is positioned above and in contact with the three silver disks. In carrying out the tests, the ball is rotated while it is pressed against the three disks at the pressure specified and by means of a suitable weight applied to a lever arm. The rotation of the steel ball on the silver disks proceeds for a period of 30 minutes at 300 revolutions per minute under 23 kilogram running load at 260° C.

The test results are determined by using a low power microscope to examine and measure the scars on the disks, and a strain gauge measures the coefficient of friction. A wear scar diameter of 2.2 millimeters or less usually indicates adequate silver wear protection. A low coefficient of friction is also required.

Lubricating oil composition formulations were prepared as described in Table I below for evaluating the silver wear protection additive composition of the present invention using the Modified Silver Wear and Friction Test.

Formulations A-E contained a medium calcium overbased sulfurized alkyl phenate having a TBN of approximately 114, wherein the alkyl group contained 12 carbon atoms and a high calcium overbased sulfurized, carbonated alkyl phenate having a TBN of approximately 250, wherein the alkyl group contained 12 carbon atoms. Formulations A-E also contained an ashless dispersant, a viscosity index improver and a foam inhibitor. Base oil was used to make-up a 100 percent of each of Formulations A-E. The TBN of the formulations was approximately 17. Formulations A-E are more fully described in Table I below.

Test Formulations B-D were prepared by addition of oleyl amine di-n-hexyl di-thiophosphoric acid and oleyl amine butyl acid phosphate employed in the silver wear protection additive composition of the present invention at three different concentrations. The silver wear protection additive composition containing 1.0 mole of the oleyl amine salt of di-n-hexyl di-thiophosphoric acid and 1.15 mole of the oleyl amine salt of butyl acid phosphate was used to prepare Formulations B-D. Comparative Formulation E contained only oleyl amine salt of di-n-hexyl di-thiophosphate.

Comparative Formulation A did not contain either the mixture of the oleyl amine salt of di-n-hexyl di-thiophosphoric acid and the oleyl amine salt of butyl acid phosphate employed in silver wear protection additive composition of the present invention or the oleyl amine salt of di-n-hexyl di-thiophosphoric acid alone. The data obtained for Formulation A was used as the baseline.

TABLE I

| | Formulation (weight %) | | | | |
|---|---|---|---|---|---|
| Components | Comparative Formulation A | Test Formulation B | Test Formulation C | Test Formulation D | Comparative Formulation E |
| Base Oil | 84.66 | 84.56 | 84.46 | 84.16 | 84.46 |
| Detergent Medium Overbased Phenate | 5.65 | 5.65 | 5.65 | 5.65 | 5.65 |
| Detergent High Overbased Phenate | 3.63 | 3.63 | 3.63 | 3.63 | 3.63 |
| Ashless Dispersant | 3.04 | 3.04 | 3.04 | 3.04 | 3.04 |
| Viscosity Index Improver | 3.0 | 3.0 | 3.0 | 3.0 | 3.0 |
| Silicon-based Foam Inhibitor | 0.02 | 0.02 | 0.02 | 0.02 | 0.02 |

TABLE I-continued

| Components | Formulation (weight %) | | | | |
|---|---|---|---|---|---|
| | Comparative Formulation A | Test Formulation B | Test Formulation C | Test Formulation D | Comparative Formulation E |
| Oleyl Amine Salt of Di-n-hexyl Di-thiophosphoric Acid + Oleyl Amine Salt of Butyl Acid Phosphate | — | 0.1 | 0.2 | 0.5 | — |
| Oleyl Amine Salt of Di-n-hexyl Di-thiophosphate | — | — | — | — | 0.2 |

Silver wear protection performance of the silver wear protection additive composition of the present invention in comparison to oleyl amine salt of di-n-hexyl di-thiophosphate alone was determined using the wear scar data and the coefficient of friction data obtained from the Modified Silver Disk Wear and Friction Test. The Modified Silver Disk Wear and Friction Test data are summarized in Table II below.

TABLE II

| Formulation | Wear Scar (μm) | Coefficient of Friction |
|---|---|---|
| Comparative Formulation A | 2.22 | 0.1490 |
| Test Formulation B | 2.23 | 0.1523 |
| Test Formulation C | 2.09 | 0.1123 |
| Test Formulation D | 2.04 | 0.1200 |
| Comparative Formulation E | 2.15 | 0.1528 |

The data in Table II above shows that Test Formulations C and D containing oleyl amine salt of di-n-hexyl di-thiophosphoric acid and oleyl amine salt of butyl acid phosphate employed in the silver wear protection additive composition of the present invention at concentrations of 0.2 weight percent and 0.5 weight percent gave significantly better silver wear protection than Comparative Formulation E containing the oleyl amine salt of di-n-hexyl di-thiophosphate alone at a concentration of 0.2 weight percent. It was surprising and unexpected that at equal concentration of 0.2 weight percent, Test Formulation C containing the mixture of oleyl amine salt of di-n-hexyl di-thiophosphoric acid and oleyl amine butyl acid phosphate employed in the silver wear protection additive composition of the present invention performed much better than Comparative Formulation E containing oleyl amine salt of di-n-hexyl di-thiophosphate alone. Since Formulation E did not show silver wear protection in this bench test, it was not included in the engine test in Example II below.

Example II

Silver Wear Evaluation Using the EMD 2-567C Engine Test

The lubricating oil Formulations described in Table III below were evaluated for silver wear protection by the standard silver bearing wear test EMD 2-567C Engine Test, also commonly known as the "2-Holer Test" used to assess the distress rating of a silver-plated wrist pin.

The 2-Holer test is approximately 35 hours in duration, comprised of 9 hours 20 minutes break-in period and 25 hours durability period. The test used two test bearings (one left side and one right side) that have been intentionally sensitized by making relative modifications in comparison to production engines equipped with production wrist pin bearings. The modifications involve not using a lead overlay on the insert bearings and no center oiling or oil slot is utilized by the test bearings. It is the as-manufactured surface of the hardened steel wrist pin that is presented directly to a clean finished silver surface of the bearing without added seating benefits of the lead overlay, or the improved oiling characteristics provided by the oil-hole feed and distribution slot. The bearings are observed for silver smear under a 10 magnification microscope, and rated according to the EMD Distress Demerit Procedure. The passing limit is 40 Demerits maximum for each bearing, and two passing bearings from one test are required before a potential railroad engine oil candidate can go into a full-scale field test.

Lubricating oil composition formulations F-J were prepared as described in Table III below for evaluating the silver wear protection additive composition of the present invention using the EMD 2-567C Engine Test.

Formulations F-J contained a medium calcium overbased sulfurized alkyl phenate having a TBN of approximately 114, wherein the alkyl group contained 12 carbon atoms and a high calcium overbased sulfurized, carbonated alkyl phenate having a TBN of approximately 250, wherein the alkyl group contained 12 carbon atoms. Formulations F-J also contained an ashless dispersant, a viscosity index improver and a foam inhibitor. Base oil was used to make-up a 100 percent of each of Formulations F-J. The TBN of the formulations was approximately 17. Formulations F-J are more fully described in Table III below.

Comparative Formulations F and J did not contain oleyl amine salt of di-n-hexyl di-thiophosphoric acid and oleyl amine salt of butyl acid phosphate employed in the silver wear protection additive composition of the present invention. Comparative Formulations F and J were used for comparison. Comparative Formulation E containing oleyl amine salt of di-n-hexyl di-thiophosphate alone used in the Modified Silver Disk Wear and Friction Test, the bench test, was not used in the EMD 2-567C Engine Test because the bench test data summarized in Table II above showed that Test Formulations C and D gave significantly better silver wear protection compared to Comparative Formulation E. Running an expensive engine test with Comparative Formulation E was deemed futile.

Test Formulations G-I were prepared by addition of oleyl amine salt of di-n-hexyl di-thiophosphoric acid and oleyl amine salt of butyl acid phosphate employed in the silver wear protection additive composition of the present invention at two different concentrations. The silver wear protection additive composition containing the oleyl amine salt of di-n-hexyl di-thiophosphoric acid and the oleyl amine salt of butyl acid phosphate in a mole ratio of 50:50 was used to prepare Formulations G-I.

TABLE III

| Components | Formulation (weight %) | | | | |
|---|---|---|---|---|---|
| | Comparative Formulation F | Test Formulation G | Test Formulation H | Test Formulation I | Comparative Formulation J |
| Base Oil | 84.93 | 84.92 | 84.93 | 84.56 | 84.67 |
| Detergent Medium Overbased Phenate | 5.38 | 5.19 | 5.18 | 5.65 | 5.65 |
| Detergent High Overbased Phenate | 3.63 | 3.63 | 3.63 | 3.63 | 3.63 |
| Ashless Dispersant | 3.04 | 3.04 | 3.04 | 3.04 | 3.04 |
| Viscosity Index Improver | 3.0 | 3.0 | 3.0 | 3.0 | 3.0 |
| Silicon-based Foam Inhibitor | 0.02 | 0.02 | 0.02 | 0.02 | 0.02 |
| Oleyl Amine Salt of Di-n-hexyl Di-thiophosphoric Acid + Oleyl Amine Salt of Butyl Acid Phosphate | — | 0.2 | 0.2 | 0.1 | — |

The results of the EMD 2-567C engine test are summarized below in Table IV.

TABLE IV

| Formulation | Piston Pin Bearing Demerits | | Pass/Fail |
|---|---|---|---|
| | Left | Right | |
| Comparative Formulation F | Break-in Fail | | Fail |
| Test Formulation G | 10.5 | 18.0 | Pass |
| Test Formulation H | 12.0 | 13.5 | Pass |
| Test Formulation I | 23.0 | 15.5 | Pass |
| Comparative Formulation J | Break-in Fail | | Fail |

The data obtained from the EMD 2-567C Engine Test show that Formulations G-I containing the silver wear protection additive composition of the present invention passed the EMD 2-567C Engine Test used for determination of protection of silver bearings, while formulations F and J, which did not contain a mixture of oleyl amine salt of di-n-hexyl di-thiophosphoric acid and oleyl amine salt of butyl acid phosphate employed in the silver wear protection additive composition of the present invention, failed the break-in.

Although, the Modified Silver Disk Wear and Friction Test (the bench test) data for 0.1 weight percent of a mixture of oleyl amine salt of di-n-hexyl di-thiophosphoric acid and oleyl amine salt of butyl acid phosphate employed in the silver wear protection additive composition of the present invention in Table II above shows that the bench test was unable to detect the silver wear protection property of this mixture at this low concentration of 0.1 weight percent, the EMD 2-567C Engine Test data given in Table IV above clearly shows that this mixture at 0.1 weight percent concentration is effective as a silver wear protection additive. This concentration may be too low for detection of silver wear protection in the bench test because of the extreme conditions employed in the bench test, namely short duration and accelerated stress.

Generally, in the petroleum industry bench tests are often used as quick screening tools to identify compounds that show promise of a particular performance criterion, and which may justify additional large expenditures in an engine test or field test. The bench test data may also assist in identifying the concentrations that may show performance in an engine test, but as seen in the present case, the lower concentrations that do not exhibit performance in the bench test, may still show very good performance in the actual engine test. The engine test is a much more reliable test to identify compounds for commercial development, and in fact, passing the engine test is an industry requirement.

What is claimed:

1. A silver bearing protection locomotive diesel engine crankcase lubricating oil composition comprising:

(A) a major amount of an oil of lubricating viscosity;

(B) a silver wear protection additive composition comprising a mixture of (i) a hydrocarbylamine salt of a di-alkyl di-thiophosphoric acid and (ii) a hydrocarbylamine salt of an alkyl acid phosphate in the range of from about 0.1 weight percent to about 1.0 weight percent based on the total weight of the lubricating oil composition, wherein the hydrocarbyl group on the hydrocarbylamine is an aliphatic group selected from an alkyl group or an alkenyl group; and (C) about 1.0 weight percent to about 10 weight percent of a mixture of a medium overbased sulfurized calcium alkyl phenate and a high overbased sulfurized, carbonated calcium alkyl phenate based on the total weight of the lubricating oil composition, wherein the high overbased sulfurized, carbonated calcium alkyl phenate has a total base number greater than 200.

2. The lubricating oil composition of claim 1, wherein in (B) the ratio of (i) the hydrocarbylamine salt of the di-alkyl di-thiophosphoric acid to (ii) the hydrocarbylamine salt of the alkyl acid phosphate in the silver wear protection additive composition is in the range of about 80:20 mole percent to about 20:80 mole percent based on the total moles of the hydrocarbylamine salts of the di-alkyl di-thiophosphoric acid and the alkyl acid phosphate.

3. The lubricating oil composition of claim 2, wherein in (B) the ratio of (i) the hydrocarbylamine salt of the di-alkyl di-thiophosphoric acid to (ii) the hydrocarbylamine salt of the alkyl acid phosphate in the silver wear protection additive composition is in the range of about 60:40 mole percent to about 40:60 mole percent based on the total moles of the hydrocarbylamine salts of the di-alkyl di-thiophosphoric acid and the alkyl acid phosphate.

4. The lubricating oil composition of claim 3, wherein in (B) the ratio of (i) the hydrocarbylamine salt of the di-alkyl di-thiophosphoric acid to (ii) the hydrocarbylamine salt of the alkyl acid phosphate in the silver wear protection additive composition is about 50:50 mole percent based on the total moles of the hydrocarbylamine salts of the di-alkyl di-thiophosphoric acid and the alkyl acid phosphate.

5. The lubricating oil composition of claim 1, wherein in (B) the hydrocarbylamine salt of the di-alkyl di-thiophosphoric acid is essentially free of mono-thiophosphoric acid.

6. The lubricating oil composition of claim 1, wherein in (B) the alkyl groups on the di-alkyl di-thiophosphoric acid and the alkyl acid phosphate are independently linear chain or branched chain alkyl groups.

7. The lubricating oil composition of claim 6, wherein the alkyl groups on the di-alkyl di-thiophosphoric acid and the alkyl acid phosphate are linear chain alkyl groups.

8. The lubricating oil composition of claim 1, wherein in (B) the alkyl groups on the di-alkyl di-thiophosphoric acid and the alkyl acid phosphate independently have from about 3 carbon atoms to about 40 carbon atoms.

9. The lubricating oil composition of claim 8, wherein the alkyl groups on the di-alkyl di-thiophosphoric acid and the alkyl acid phosphate independently have from about 3 carbon atoms to about 20 carbon atoms.

10. The lubricating oil composition of claim 9, wherein the alkyl groups on the di-alkyl di-thiophosphoric acid and the alkyl acid phosphate independently have from about 4 carbon atoms to about 10 carbon atoms.

11. The lubricating oil composition of claim 1, wherein the alkyl group or the alkenyl group on the hydrocarbylamine has from about 8 carbon atoms to about 40 carbon atoms.

12. The lubricating oil composition of claim 11, wherein the alkyl group or the alkenyl group on the hydrocarbylamine has from about 12 carbon atoms to about 20 carbon atoms.

13. The lubricating oil composition of claim 1, wherein in (B) the hydrocarbylamine salts of the di-alkyl di-thiophosphoric acid and the alkyl acid phosphate are mono-hydrocarbylamine salts, di-hydrocarbylamine salts, tri-hydrocarbylamine salts, or mixtures thereof.

14. The lubricating oil composition of claim 13, wherein the hydrocarbylamine salts of the di-alkyl di-thiophosphoric acid and the alkyl acid phosphate are mono-hydrocarbylamine salts.

15. The lubricating oil composition of claim 1, wherein in (B) the alkyl group on the di-alkyl di-thiophosphoric acid is n-hexyl, the alkyl group on the alkyl acid phosphate is n-butyl and the hydrocarbyl group on the hydrocarbylamine is oleyl.

16. The lubricating oil composition of claim 1, wherein the lubricating oil composition has a Total Base Number is in the range of from about 5 to about 30.

17. The lubricating oil composition of claim 16, wherein the Total Base Number is in the range of from about 15 to about 25 based on the total lubricating oil composition.

18. The lubricating oil composition of claim 1, wherein the lubricating oil composition further comprises one or more lubricating oil additives selected from dispersants, anti-oxidants, viscosity index improvers and corrosion inhibitors.

19. The lubricating oil composition of claim 18, wherein the lubricating oil composition further comprises one or more dispersants.

20. The lubricating oil composition of claim 19, wherein the dispersants are ashless dispersants.

21. The lubricating oil composition of claim 20, wherein the ashless dispersant is a derivative of succinic anhydride.

22. The lubricating oil composition of claim 1, wherein the lubricating oil composition passes the EMD 2-567C Engine Test.

23. A method for protecting silver bearings in a locomotive diesel engine crankcase comprising contacting the silver bearings with the lubricating oil composition of claim 1.

24. A method for protecting silver bearings in a locomotive diesel engine crankcase comprising contacting the silver bearings with the lubricating oil composition of claim 15.

* * * * *